United States Patent [19]

Bücker et al.

[11] 4,265,742

[45] May 5, 1981

[54] SCREEN ELEMENT

[75] Inventors: Fritz O. Bücker, Pretoria; Henning F. W. M. A. Lambrecht, Johannesburg, both of South Africa

[73] Assignee: Hermann Screens Manufacturing Company (Proprietary) Limited, Edenvale, South Africa

[21] Appl. No.: 51,442

[22] Filed: Jun. 25, 1979

[51] Int. Cl.[3] ..... B07B 1/46

[52] U.S. Cl. ..... 209/399; 209/281; 209/405

[58] Field of Search ..... 210/498

[56] References Cited

U.S. PATENT DOCUMENTS

| | | | |
|---|---|---|---|
| 959,979 | 5/1910 | Webb et al. | 209/405 |
| 1,940,952 | 12/1933 | Hutchens | 210/498 |
| 3,483,976 | 12/1969 | Williams | 209/274 X |
| 3,833,120 | 9/1974 | Ogata | 209/399 |
| 3,943,054 | 3/1976 | Simonson | 209/392 |
| 3,970,550 | 7/1976 | Fry et al. | 209/399 |
| 3,980,555 | 9/1976 | Freissle | 209/408 |

FOREIGN PATENT DOCUMENTS

| | | | |
|---|---|---|---|
| 2380080 | 1/1978 | France | 209/408 |
| 73/7497 | 11/1973 | South Africa . | |
| 73/5815 | 12/1973 | South Africa . | |
| 74/2825 | 5/1974 | South Africa . | |
| 74/5092 | 8/1975 | South Africa . | |
| 75/2229 | 3/1975 | South Africa . | |
| 75/6585 | 10/1976 | South Africa . | |
| 1289537 | 9/1972 | United Kingdom . | |
| 1485748 | 9/1977 | United Kingdom . | |

*Primary Examiner*—Ralph J. Hill

*Attorney, Agent, or Firm*—Berman, Aisenberg & Platt

[57] ABSTRACT

The invention provides screen elements of polyurethane, or a material having similar characteristics, having metal reinforcing rods embedded in and extending only in a single direction and across the full width of the screen element between lateral support zones. A plurality of screen elements can be replaceably secured to a complementally shaped support frame member by a combined elongate fastening formation formed by two abutting elongate fastening formations respectively of two screen elements in edge-to-edge abutting relationship. For this purpose each screen element has an elongate fastening formation along the under side of each of its two opposite lateral edges, in addition to one or more securing formations at each end to secure screen formations together in end-to-end relationship. The invention also provides a screen deck consisting of screen elements secured to support frame members, as described above.

The invention further provides a screening apparatus, such as a sieve bend, including such a screen deck.

19 Claims, 10 Drawing Figures

SCREEN ELEMENT

BACKGROUND OF THE INVENTION

This invention relates to screen elements for screening apparatus; it further relates to screen decks and screening apparatus provided with such screen elements for screening particulate material, such as ores, minerals and raw materials.

Various types of screen elements have hitherto been proposed, for example in U.S. Pat. No. 3,970,550, wherein wire cables are moulded into ribs on the underside of a screen and protrude from the screen at each edge to be tensioned by devices on the frame of the screen apparatus when in use. U.S. Pat. No. 3,980,555 discloses a wear-resistant screening element of a synthetic plastic material, such as polyurethane, having a plurality of discrete protrusions along all four of its edges to allow the protrusions of adjacent screening elements to be clipped into the same openings in a support frame. A reinforcing grid may be moulded into the screening element.

United Kingdom Pat. No. 1,289,537 shows (screen) plates having a plurality of separate anchoring projections provided on three or four edges of each plate, each projection being shaped to engage and support a reinforcing member in a joint between adjacent plates. The reinforcing member is not moulded into a screen plate during manufacture thereof, but between adjacent plates during assembly of the screen as a whole. United Kingdom Pat. No. 1,485,748 discloses a screening machine including a lattice support frame of polyurethane, each square of the lattice being dimensioned to accept one modular screening element. The support frame has embedded therein a ribbed channel having protruding interrupted projections which engage a complemental undercut in the underside of all four edges of a screen element.

South African Pat. No. 73/7497 discloses a screen having a plurality of interengageable (screening) modules, being clamped together by tensioning rods passing through apertures in each module. Similar disadvantages apply as in the case of U.S. Pat. No. 3,970,550. South African Pat. No. 74/5092 shows screening elements secured to a support means having a plurality of nodule-like securing formations and a similar plurality of complemental formations spaced along all four edges of the screening elements. South African Pat. No. 75/2229 describes screening elements secured around all four edges to frame members, and it has the disadvantages inherent in this mode of fastening, as previously described.

An object of the present invention is to eliminate the disadvantages of existing screen elements and modes of attachment to support frames therefor, as previously described.

Another object is the provision of new, improved and highly effective screen elements and improved means for attachment to and support by support frames, as well as screening apparatus including such screen elements. More particularly, this is achieved by providing screen elements and support frame members therefor, which have a rigid mounting interaction resulting in less sag and distortion of screen elements, easy removal and replacement of any worn or damaged screen elements, joints between adjacent screen elements being protected against entry of particles, a high ratio of apertured area to total screen surface leading to high screen throughput, and particularly advantageous "whip" or "life" of each screen element because of the mode of reinforement coupled to the material of the screen element, also leading to high screen throughput.

SUMMARY OF THE INVENTION

The present invention relates to a replaceable screen element of polyurethane or a material having similar characteristics, the screen element having an apertured body portion extending between two opposite sides and two opposite ends, each side including a continuous elongate fastening formation extending along substantially the entire length of the side for fastening of the screen element along both sides to a screen support frame, each fastening formation being adapted to form, with a corresponding fastening formation of an adjoining similar screen element, a matching combined pair when two screen elements are fitted closely together in edge-to-edge relationship, the pair being adapted to be brought into releasable substantially unyielding positive engagement with a complementary elongate fastening formation of the screen support frame.

Preferably the body portion of the screen element includes a plurality of elongate apertures, each elongate aperture being bordered on two opposite elongate sides by parallel screen rods, each screen rod having embedded therein an elongate reinforcing member of a metal more rigid than the material of the screen element, extending across the entire width of the screen element in a single direction only, normal to the fastening formations.

The invention also relates to a screen deck comprising a plurality of screen elements in combination with a corresponding plurality of support members of a screen element support frame, each screen member being as herein described.

The invention further relates to a screening apparatus such as a sieve bend, comprising a screen element support frame and a plurality of screen elements, each screen element being as herein described.

The invention will appear more clearly from the following detailed description and drawings showing by way of example only, preferred embodiments of the invention.

BRIEF DESCRIPTION OF DRAWINGS

In the drawings:

FIG. 3(*b*) is a partial plan view of the screen deck of FIG. 3(*a*);

DESCRIPTION OF THE PREFERRED EMBODIMENTS

Figure 1:
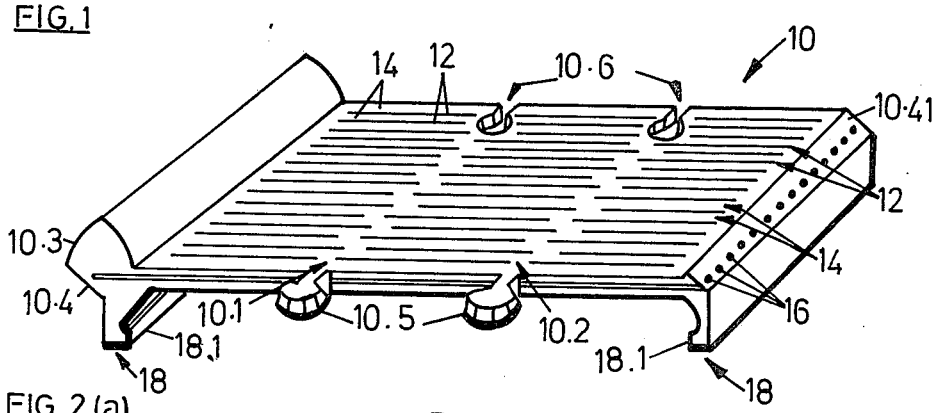
FIG. 1 is a 3-dimensional view of a screen element, viewed from above.

In the drawings, unless otherwise indicated, like reference numerals refer to like parts.

Referring firstly to FIG. 1, reference numeral 10 refers generally to a screen element of polyurethane having a plurality of elongate apertures or slots 12 in the body part thereof. Each slot 12, of which there are three in a single row across the width of the screen element 10, is bordered by two screen bars 14, each screen bar 14 having embedded therein a steel rod 16 extending across the entire width of the screen element 10 for reinforcing purposes. It is also possible to locate, during casting, a steel rod 16 in every alternate screen bar, if desired. Preferably, each steel rod 16 is located in its screen bar 14 nearer the lower surface thereof. More or fewer slots 12 may be provided, if desired, along the screen element 10. The slots 12 are arranged in rows along the screen surface in a staggered array as seen by the correspondingly-staggered bridging formations 10.1, 10.2. Staggering may be more exaggerated than that shown in FIG. 1, if desired, the prime consideration being that "dead" or unapertured areas should be avoided or reduced as far as possible along the length of the screen element.

The screen element 10 has a ridge 10.3 extending along the length of the screen surface along its one upper edge, inter alia to provide a type of cover which tightly overlaps the junction of screen elements when in a lateral abutting relationship.

Figure 2:
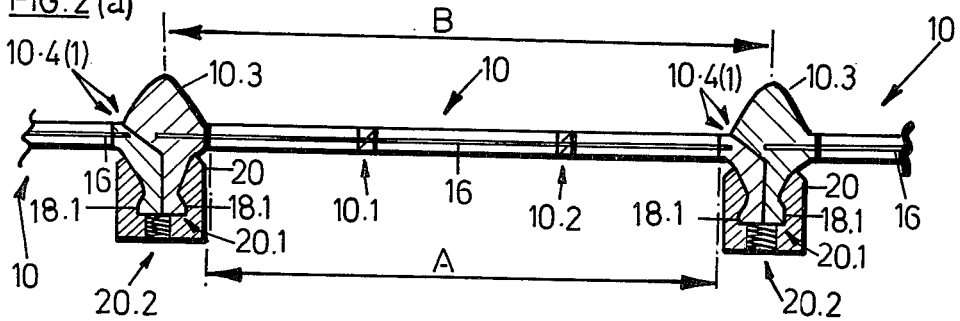
FIGS. 2(*a*), (*b*) and (*c*) are partial front sectional views of three assembled screen decks respectively.
Figure 2:
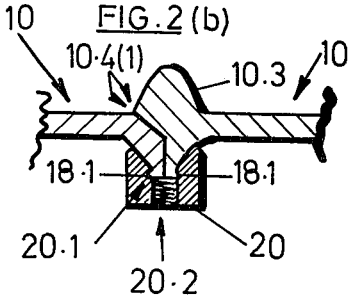
Figure 2:
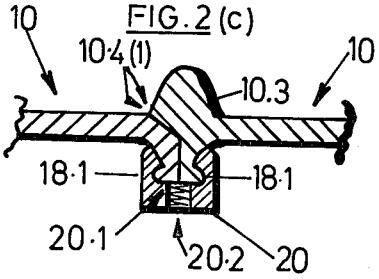

The screen element 10 also has a pair of opposed elongate lateral fastening formations 18,18 extending along the underside of the screen element 10 at the two lower (lateral) edges indicated, each formation 18 having an elongate protrusion 18.1, for fastening to a complementary formation of a support member (not shown See FIGS. 2). Each formation 18 also incidentally acts as a stiffener for the screen element 10 along the length of its respective edge.

The screen element 10 further has a pair of securing formations in the form of two engaging buttons 10.5, 10.5 at its nearer end and two corresponding recesses 10.6, 10.6 at the (further) opposite end. The buttons are preferably slightly larger in plan view than the recesses to ensure tight engagement of adjacent screen elements when secured together in end-to-end fashion. One or more than two such buttons and corresponding recesses may be provided at each end.

Although the screen element is preferably made of polyurethane, or a material containing polyurethane, it is not limited to these materials, the criterion being that the material should have the physical characteristics of polyurethane, particularly in respect of the wearing and resilient characteristics of polyurethane. Any suitable plastic or elastomeric material may be used, for example, nylon or neoprene.

Referring to FIG. 2(*a*), three screen elements 10 are shown assembled in lateral edge-to-edge relationship to form part of a screen deck having a screen surface extending across the upper surfaces of the screen elements 10.

Each chamfered shoulder 10.4 of a screen element 10 fits snugly against the corresponding shoulder 10.41 of an abutting screen element. In this way the ridge 10.3 of each screen element protects and seals the junction situated below it.

When two screen elements 10,10 are placed side by side as explained above, the fastening formations 18,18 located side by side form a complementary pair and present a combined elongate male formation with two opposed elongate protrusions 18.1, 18.1 which interlock snugly with the corresponding elongate female formation 20.1 of an elongate member 20 of a screen support frame, (not shown fully). Preferably the combined male formation is slightly oversize to ensure a tight fit. The support member 20 thereby secures each abutting pair of screen elements 10,10 together, and rigidly to itself, and prevents vertical movement of either of the screen elements 10,10. The combined (male) formation has a size and shape such that it engages the female formation 20.1 of the support member 20 when the screen elements 10, held in the above described lateral abutting relationship, are either slid longitudinally along a member 20 or conveniently pressed downwardly into the member 20 to form part of an interlocked screen deck as shown. Removal is effected conveniently by simply lifting or raising a screen element 10 to disengage from its support member 20.

The ridge 10.3 of each screen element 10 serves to protect and seal the junction located under it against entry of particles being screened, as well as to encourage flow of material along its length and hence along the screen deck when it is in operation.

Each support member 20 has at least one screw hole 20.2 for securing to a screen support frame (not shown). The support members 20 may, for example, be of steel, aluminium, or the like, and are continuous along the length of the underside of the screen deck.

At either end of the screen elements, further screen elements can be joined to the screen elements shown in end-to-end relationship by means of engaging the buttons 10.5 and recesses 10.6 of adjoining screen elements, respectively.

Referring to FIGS. 2(*b*) and 2(*c*), two screen elements 10,10 are shown assembled in lateral edge-to-edge relationship. Each screen element 10 has a formation 18 with a different profile, especially in respect of the elongate protrusions 18.1, 18.1 shown in FIG. 2(*b*) and FIG. 2(*c*), respectively. Whilst FIG. 2(*a*) shows a squaretype fastening formation, FIG. 2(*b*) shows a dovetail fastening formation, and FIG. 2(*c*) shows a bulbed end fastening formation.

The ratio A:B in FIG. 2(*a*) i.e. screen width to overall aperture length, may be less than or in the region of approximately 1:1,10, thereby providing a highly favourable ratio of apertured area to total screen surface. This leads to high throughput per unit area of screen surface.

Preferably a support frame (not shown) has members corresponding to each member 20.

A screen deck as shown in FIG. 2(*a*) (*b*) or (*c*) has the advantage that any screen element 10 thereof may be readily replaced, when worn for example, i.e. readily removed and replaced by a new screen element. This type of screen deck has the additional advantage of improved rigidity along the two lateral edges of each screen element 10, which in turn means that there is reduced sag of each screen element 10 and therefore reduced distortion of aperture sizes when the screen deck is loaded with any material to be screened.

At each extreme outer edge (not shown), of the screen deck of FIG. 2(*a*), a combined male formation will be formed by the formation 18.1 of the outermost screen element and the formation 18.1 of a "dummy" screen element. The so-called dummy screen element may consist either of a full screen element, which does not form part of the effective screen surface, or may simply be a lateral (elongate) edge part of a screen element to compile the combined formation required to engagage the support member.

Figure 3:
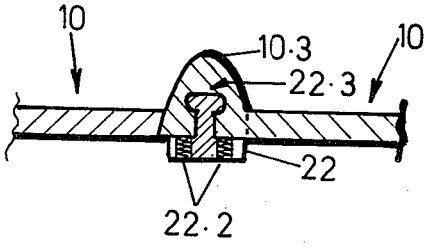
FIG. 3(*a*) is a partial front sectional view of another form of an assembled screen deck.
Figure 3:
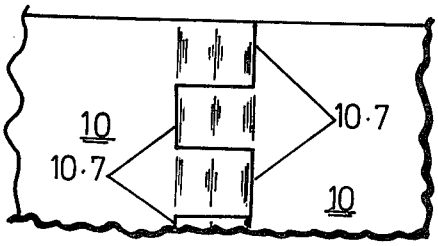

FIGS. 3(*a*) and (*b*) show part of a screen deck assembled from screen elements 10 and support members of which only one viz 22 is shown, each screen element 10 having inter-protruding formations 10.7 in plan view (see FIG. 3(*b*). In this case, the abutting screen element edges present a combined female formation in end view (See FIG. 3(*a*) whilst each member 22 has a corresponding male formation 22.3.

The screen deck in the case of FIGS. 3(*a*) and (*b*) is assembled by a longitudinal sliding action of the member 22 along the combined edge formation of the screen elements 10. Each member 22 can be secured to a support frame (not shown) for the screen deck, i.e. by means of screwed holes 22.2. Preferably the support frame has members corresponding to each member 22.

Figure 4:
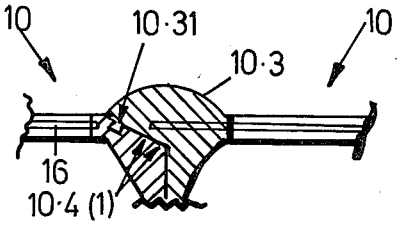
FIG. 4 shows a partial front sectional view of a detail of a junction between two screen elements.

Referring to FIG. 4, a screen deck junction is shown having a lower profile ridge 10.3, the junction being otherwise similar to the junctions shown in FIG. 2 except for a dovetail-like protrusion 10.31 under the ridge 10.3 for engaging a corresponding dovetail groove in the adjacent element to prevent the junction under the ridge 10.3 from opening when the screen elements 10 flex under a load of particulate material (not shown) to be screened or sieved. Such a junction as described above will tend not to open under load during screening, and abrasive fine material will not easily enter the junction under the ridge 10.3.

Figure 5:
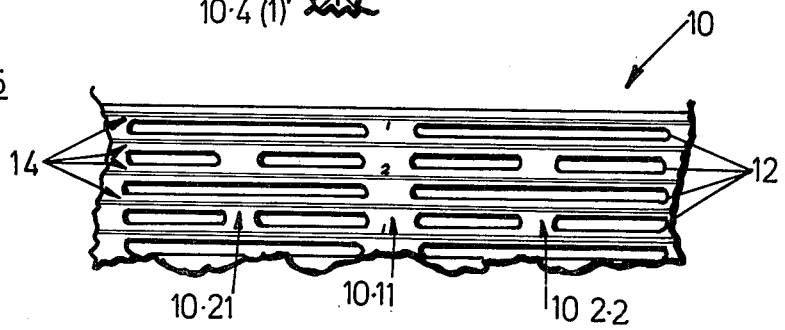
FIG. 5 shows a partial plan view of a portion of a screen element surface with a different configuration of apertures compared to the screen element surface shown in FIG. 1.

Referring next to FIG. 5, a different array of slots 12 is shown in a screen 10, one set of bridging formations 10.11 being aligned whilst the sets 10.21, 10.21 adjacent thereto are in a separated array. Reinforcing rods 16 may be embedded in every row of screen bars 14 or in alternate rows of screen bars, at 1 and 2 for example, in repetitive mode along the length of the screen element.

These screen elements may be readily cast or injection-moulded, for example, from polyurethane with steel reinforcing rods set in the mould beforehand.

The screen elements as shown in FIGS. 1 to 5 generally present increased screening efficiency having a most favourable aperture area to screen surface ratio, i.e. these screen elements are conductive to high screen throughput rates per unit of screen surface.

These screen elements have a relatively long service life, and may be easily replaced by replacement screen elements when and as required by removing worn or damaged screen elements from the support member and fitting a replacement screen element. Whilst a replacement screen element may be slid in and out of its support member, it may, if desired, also be eased in (and out) if sufficient force normal to the screen surface is applied to the screen element near its edges.

A particular advantage of these screen elements is their flexibility or 'life' or 'spring' during vibratory operation as a result of the particular combination of the material of the screen element and the mode of reinforcing, and to a certain extent by the rigid attachment of each screen element to the support frame. This property is especially desirable for screening lighter particulate materials, i.e. materials, having a lower specific gravity. This 'life' or 'spring' assists in screening of such materials by virtue of a particular type of vibration of the screen surface which is partially damped by the reinforcing rods 16 extending across the entire width of each element 10. This method of reinforcing also assists in preventing sag and distortion of each screen element.

Figure 6:
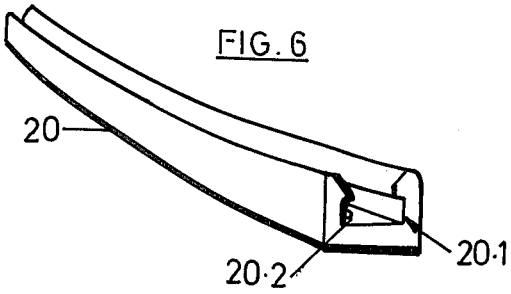
FIG. 6 is a 3-dimensional view of a support member of a screen support frame.

Referring now to FIG. 6, another form of a member 20 is shown, the member 20 being bent in concave fashion along its length. When a number of such members 20 are used to make up a screen deck, any material for screening will tend to gravitate conveniently toward the central (or lower) part of the members 20.

Each member 20 may be provided in any convenient length, so that a plurality of members is used along the length of a screen deck.

Figure 7:
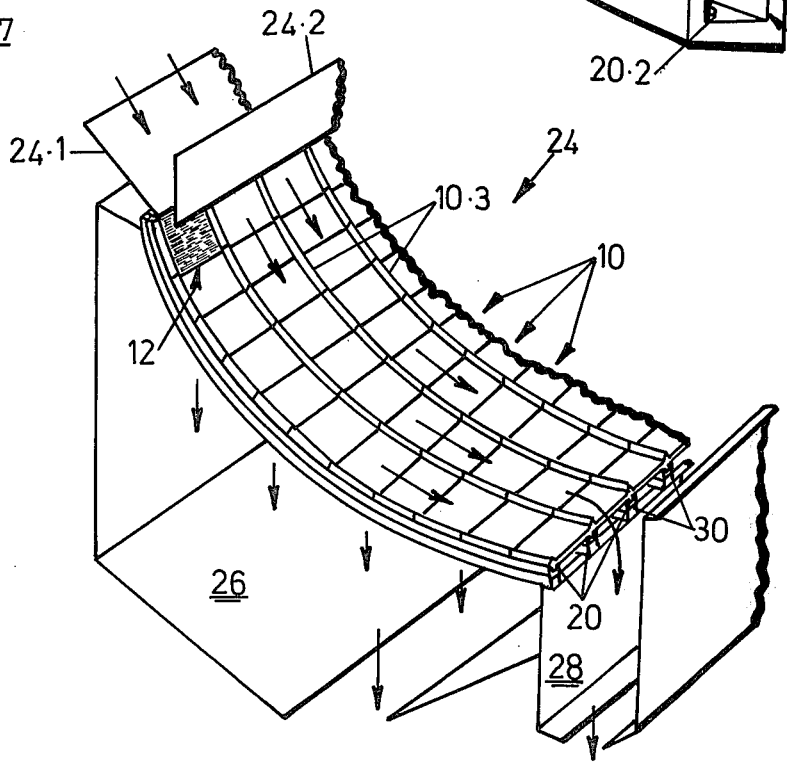
FIG. 7 is a partial 3-dimensional view of a screening apparatus including a screen deck as shown in FIG. 2(*a*).

Referring now to FIG. 7, an assembled screen deck is shown in the form of a screening apparatus known as a sieve bend 24, fitted above two bins 26 and 28. The screen deck is assembled from screen elements 10 and members 20, as shown in FIG. 2(*a*) and described above. Each member 20 is of the bent type, as shown in FIG. 6. Each member 20 is suitably fastened to a corresponding inverted channel member 30 by a number of screws, and each channel member 30 is in turn fastened at its extremities to the upper parts of the bin 26 on which it is supported. Alternatively, the members 20, being self-supporting, may be secured directly at each end to the upper parts of the bin 26.

A side panel (nearest the viewer) of the bins has been removed to show the assembled detail of the sieve bend more clearly.

In use, the sieve bend 24 may be vibrated, if desired, by any known means, and particulate material (not shown) to be screened is fed onto inlet plate 24.1 as indicated by the arrows.

A suitable deflector plate 24.2 ensures that the material is directed towards and onto the screen deck. The material is then gravity-fed over the screen deck surface, and particles smaller than the effective aperture width of the screen elements 10 pass through the apertures 12 of the screen elements 10 into the bin 26. For purposes of illustration apertures 12 have been shown in only one screen element. Material flow is thus preferably transverse to the longitudinal axes of the elongate apertures 12, although flow may alternately be parallel, if desired. In the case of a horizontal screening apparatus (not shown), for example, flow of material may preferably be parallel to the longitudinal axes of the elongate apertures 12.

Vibration of the screen deck assists in the screening process, and if the screen elements are made, for example, of polyurethane, each screen element has a desirable amount of flexibility, or 'life' or 'whip', which further encourages rapid screening, especially for materials of lighter specific gravity, such as coal. Naturally, however, any other material or ore, for example diamondiferous ore, can also be screened advantageously.

Oversize material will travel along the screen deck surface until it reaches the end of the screen deck, where it will fall into the bin 28, as shown by the arrow.

Each screen element 10 may have apertures of roughly triangular cross-section surrounded on two sides by solid portions, each of which may have a roughly inverse triangular cross-section, and may include a suitable reinforcing member, e.g. a steel wire or rod, embedded therein for reinforcing purposes.

The members 20 may alternatively be of any suitable structure so as to clamp together the combined formation, e.g. 18.1, 18.1, by means of a clamp, clip, or the like construction. Similarly, the members 20 may be straight, bent or curved in any preferred shape to provide the best screening performance under given conditions.

A particular advantage of the arrangement described above is that any worn or damaged screen element 10 may be readily replaced in the screen deck, as required. Similarly, an entire deck may be readily replaced in the sieve bend, or a similar screening apparatus.

Since the formations 20 are located along two sides only of the screen elements 10, the length of each screen element 10 is not restricted to any specific length. Consequently a screen element may be made and used in any length, preferably being fairly long with any excess length merely protruding beyond the screen element frame for feeding into the screen element frame, or being cut off, as desired.

It is thus possible to effectively replace a worn or damaged screen element merely be sliding in or otherwise inserting a replacement screen element for any worn or damaged screen element, without removing other screen elements and essentially with minimal interruption of the operation of the screening apparatus.

We claim:

1. A replaceable plastic or elastomeric screen element having an apertured body portion extending between two opposite sides and two opposite ends, each side including a continuous elongate protruding fastening means extending along substantially the entire length of the side for fastening the screen element along each side to a screen support member, each fastening means being adapted to form, with a corresponding fastening means of an adjoining similar screen element, a matching combined pair when two screen elements are fitted closely together in edge-to-edge relationship, the pair being adapted to be brought into releasable substantially unyielding positive engagement with a complementary elongate fastening recess of the screen support member.

2. A replaceable screen element according to claim 1 wherein the screen element is a polyurethane screen element.

3. A replaceable plastic or elastomeric screen element having an apertured body portion extending between two opposite sides and two opposite ends, each side including a continuous elongate recessed fastening means extending along substantially the entire length of the side for fastening the screen element along each side to a screen support member, each fastening means being adapted to form, with a corresponding fastening means of an adjoining similar screen element, a matching combined pair when two screen elements are fitted closely together in edge-to-edge realtionship, the pair being adapted to be brought into releasable substantially unyielding positive engagement with a complementary elongate fastening protrusion of the screen support member.

4. A replaceable screen element according to claim 3 wherein the screen element is a polyurethane screen element.

5. A screen element according to claim 1 or claim 3 wherein the body portion comprises a plurality of elongate apertures, each elongate aperture being bordered on two opposite elongate sides by parallel screen rods, each screen rod having embedded therein an elongate reinforcing member of a metal more rigid than the material of the screen element, extending across the entire width of the screen element only in one direction, normal to the fastening means.

6. A screen element according to claim 1 or claim 3 which comprises a continuous lateral formation protruding above the surface of the body portion and tightly overlapping the junction between two screen elements in edge-to-edge abutting relationship when secured to the screen support member.

7. A screen element according to claim 1 or claim 3 the matching fastening means of two laterally abutting screen elements being of different configuration but forming a complementary pair.

8. A screen element according to claim 1 or claim 3, including a continuous lateral formation which tightly overlaps the junction between two screen elements in edge-to-edge abutting relationship when secured to the screen support member.

9. A screen element according to claim 1 or claim 3, including at least one securing formation provided along each of its two opposite ends for securing the screen element to one or more complementary securing formation(s) of another screen element in end-to-end abutting relationship with the first screen element.

10. A screen element according to claim 1 or claim 3, the body portion including a plurality of elongate apertures, each elongate aperture being bordered on two opposite elongate sides by parallel screen rods, each screen rod having embedded therein an elongate reinforcing member of a metal more rigid than the material of the screen element, extending across the entire width of the screen element only in a single direction, normal to the fastening formations.

11. A screen element according to claim 10, each pair of screen rods being joined by one or more bridging formations.

12. A screen element according to claim 11, the bridging formations being arranged in a staggered array along the length of the screen element.

13. A screen element according to claim 11, at least one series of aligned bridging formations joining each pair of screen rods, and at least one other series of aligned bridging formations joining each alternate pair of screen rods, along the length of the screen element, when each pair of screen rods is joined by more than one bridging formation.

14. A screen element according to claim 10, the ratio of screen width to aperture length being less than 1:1.10.

15. A screen element according to claim 10, the ratio of screen width to aperture length being approximately 1:1.10.

16. A screen deck comprising a plurality of screen elements in combination with a corresponding plurality of support members of a screen element support frame, each screen element being as claimed in claim 1 or claim 3.

17. A screening apparatus comprising a screen element support frame and a plurality of screen elements, each screen element being as claimed in claim 1 or claim 3.

18. A screening apparatus according to claim 17, including a plurality of support members, each support member including a continuous elongate fastening means having a shape complementary to and engageable with an elongate combined means formed by the fastening means, respectively, of two laterally-abutting screen elements in edge-to-edge abutting relationship.

19. A screening apparatus according to claim 17, the screening apparatus being a sieve bend.

* * * * *